United States Patent [19]

Mattina

[11] 4,308,877

[45] Jan. 5, 1982

[54] METHOD OF MAKING RECONSTITUTED TOBACCO HAVING REDUCED NITRATES

[75] Inventor: Charles F. Mattina, Lenox, Mass.

[73] Assignee: Kimberly-Clark Corporation, Neenah, Wis.

[21] Appl. No.: 883,449

[22] Filed: Mar. 6, 1978

[51] Int. Cl.[3] ..... A24B 15/18; B24B 15/20; A24B 15/24

[52] U.S. Cl. ..... 131/297; 131/308; 131/370

[58] Field of Search ..... 131/140 C, 143, 141, 131/140 R, 140 B, 17 A, 17 AB, 17 AC, 17 AD, 17 AE, 308, 297, 370–375

[56] References Cited

U.S. PATENT DOCUMENTS

| | | | |
|---|---|---|---|
| 2,000,855 | 5/1935 | Lippmann et al. | 131/143 X |
| 3,709,364 | 1/1973 | Savage | 210/11 |
| 3,847,164 | 11/1974 | Mattina et al. | 131/143 |
| 4,037,609 | 7/1977 | Newton et al. | 131/141 |
| 4,038,993 | 8/1977 | Geiss et al. | 131/141 |
| 4,043,936 | 8/1977 | Francis et al. | 210/11 |
| 4,131,117 | 12/1978 | Kite et al. | 131/143 X |
| 4,131,118 | 12/1978 | Gellatly et al. | 131/143 |

*Primary Examiner*—V. Millin

*Attorney, Agent, or Firm*—Alan H. Levine

[57] ABSTRACT

Natural tobacco is extracted with water to produce a soluble extract and an insoluble fibrous residue. The aqueous extract is contacted by microorganisms, such as bacteria or fungi, capable of converting nitrate in the extract to nitrogen. Contacting may be done by adding a microorganism culture to a batch of the extract, or by passing the aqueous extract through a filter carrying a supply of the microorganisms. In either case, the contacting should take place in a substantially anaerobic environment. The culture may be produced by cycling a quantity of tobacco extract through a filtering medium to promote the growth of microorganisms occurring naturally in tobacco. Carbohydrate and/or protein is added to the denitrated extract to replace compounds depleted during the denitrating procedure. Ultimately, the denitrated extract is recombined with the fibrous tobacco residue.

4 Claims, No Drawings

METHOD OF MAKING RECONSTITUTED TOBACCO HAVING REDUCED NITRATES

This invention relates to reconstituted tobacco, and more particularly to a method of making reconstituted tobacco from which a substantial proportion of the nitrate has been removed.

Reconstituted tobacco as such is well known. One way of producing reconstituted tobacco is to extract the soluble ingredients of natural tobacco, which preferably has been macerated or comminuted in preparation for extraction. The extraction is performed by use of water, and generally withdraws from 30 percent to 55 percent by weight of the starting material. An aqueous slurry is then formed containing the fibers, and by usual papermaking techniques, the slurry with or without additives is transformed into a selfsustaining web. The tobacco extract, which may be concentrated to a liquor, is then introduced into the web. The application of the extracted tobacco material may be achieved in any appropriate manner, as by spraying, saturating, or otherwise.

According to the present invention, after the extraction step but before the tobacco extract is recombined with the fibrous web, the extract is treated biologically to reduce its content of nitrate. The invention has particular value in connection with reconstituted tobacco made from appreciable proportions of burley tobacco midribs since these contain substantial amounts of potassium nitrate. However, the invention is not limited to use with any specific type of tobacco.

Removal of potassium nitrate from tobacco is desirable for several reasons. First, the burn rate of tobacco products is decelerated when the nitrate is eliminated. Secondly, the generation of several components in the smoke, among them oxides of nitrogen, methylnitrate, and acetonitrile, is reduced. Some of these compounds have been suggested to be undesirable constituents in the smoke from the health standpoint. Furthermore, when potassium nitrate is burned, it produces an acrid smoke reminiscent of burned gunpowder.

In general, the idea of removing nitrate from aqueous tobacco extract is not new. In U.S. Pat. No. 3,847,164 a process is described in which the extract is contacted with ion retardation resin for removal of nitrate ion. The present invention differs, radically, in that microorganisms such as certain bacteria and fungi, or more specifically, enzymes produced by microorganisms, are employed to alter the nitrate to the form of other nitrogen containing chemical entities.

Certain microorganisms are known which utilize nitrate as their source of oxygen. Most of these microorganisms are anaerobic but some function at relatively high oxygen tensions. By means of the microorganisms, the nitrate is reduced, i.e., converted to elemental nitrogen. Processes employing this principle have been proposed for the denitrification of surface and ground waters.

The reduction of nitrate to nitrogen requires the transfer of electrons from other compounds. Certain of these donor compounds are present in tobacco, and enzymes serve as conduits for transferring the electrons from donor compounds to the nitrate. In this connection, it may be mentioned that since the enzymes serve only as conduits for transferring electrons, and otherwise do not get involved, the enzymes are not consumed and hence need not be replenished.

There are numerous types of microorganisms which will accomplish the reduction. For example, several strains of bacteria can be used, most of these belonging to the genus Pseudomona, but other genera (Hyphomicrobium, certain Bacillus, Xanthomona, etc.) can achieve the desired result. In fact, any microorganism capable of producing enzymes for causing the nitrate in aqueous tobacco extract to accept electrons from other constituents of the extract and so become reduced to nitrogen can be employed for the purposes of the present invention. Enzymes which have been found to perform satisfactorily include nitrate reductase, nitrite reductase, and various cytochromes, e.g., a-, b-, and c-type cytochromes.

One method of employment of microorganisms, according to this invention, is to prepare a bed containing appropriate microorganisms, such as bacteria, through which the liquid is passed for treatment. It happens that bacteria capable of reducing nitrate are present naturally in tobacco. Therefore, such a bed may be generated by repeated cycling of aqueous tobacco extract, containing from 1% to 15% dissolved solids, through a bed of soil, gravel or sand. It is essential that this process be carried out under anaerobic or near-anaerobic conditions. Anerobic conditions are present, for example, in a closed, liquid-filled system, or in the lower portion of a deep liquid-filled tank. After several hours, the denitrifying bacteria will begin to enrich on the surface of the medium. It is important to monitor the nitrate during the recycling and to stop the process after the nitrate concentration levels off or decreases to zero. Otherwise the growth of undesirable bacteria will be enhanced. At the completion of the growth cycle, the gravel, soil, or said denitrifying bed is ready for use. Monitoring the nitrate may be accomplished by regularly taking and testing samples of the extract being cycled. Assuming the extract is being cycled through a closed system, including the bed, by means of a pump, the process may be stopped by shutting off the pump.

In use, an aqueous extract of tobacco can be passed through such an anaerobic filter. The size of the bed and/or the rate of flow of extract should be adjusted depending upon the concentration of nitrate in the incoming stream and the degree of denitrification required. Intimate contact of the extract with the microorganisms is essential for efficient removal of nitrate. Since the microorganisms are present on the filter in quantity, they efficiently obtain oxygen from the nitrate in the extract and reduce it to nitrogen.

Care must be taken that the anaerobic filter is not exposed directly to air. The reason is that the denitrifying microorganisms can also utilize oxygen directly and this will inhibit their ability to reduce nitrate.

As mentioned above, electron donor compounds are required in order for denitrification to proceed. Aqueous tobacco extract provides an abundance of these, but it appears that organic acids, sugars, and protein are preferentially oxidized. Since each equivalent of nitrate removed requires an equivalent of donor compound, the removal of substantial quantities of nitrate from tobacco extracts by denitrification will result in a decrease in the level of other desirable organic compounds. Thus, it may be desirable to replenish these losses after the denitrification is complete.

The process is ideal when the pH of the aqueous extract is in the range of seven to eight, slowing markedly below six where the reduction of nitrate to nitrite becomes the principal reaction. In fact, this reduction to nitrite is the first step in the denitrification process; some accumulation of nitrite occurs during denitrification but eventually all is converted to nitrogen gas. If the pH of the extract to be subjected to denitrification is below seven, alkali may be added to raise the pH to the optium range.

The denitrification is relatively insensitive to temperature but optimal removal is accomplished above 5° C. and below 35° C.

A typical procedure involves extracting the tobacco material with water, either at room temperature or at elevated temperature. This can be a simple extraction, or could be done in multiple countercurrent stages. The resulting extract should have a concentration of solids ranging from 4% to 15%. This extract is treated on a continuous basis by passing it through an anaerobic denitrifying filter, as described above, or in a batch process by the addition of a microorganism culture to the extract and holding of the liquid for a period of time, preferably from two to 24 hours during which the reaction takes place. The extract then may be concentrated by evaporation before being used to impregnate a paperlike base sheet formed from the insoluble fibrous portion of the tobacco remaining after completion of the extraction process.

EXAMPLE I

Burley tobacco midribs were extracted with water and the fibrous residue formed into a paper-like sheet by ordinary papermaking techniques. A portion of the extract was recycled in a closed loop over a bed comprising coarse gravel, sand, and soil for a period of 10 hours at ambient temperature. During that time the nitrate concentration decreased from 0.2 milliequivalents (meq) $NO_3^-$/milliliter (ml) to 0.005 meq $NO_3^-$/ml. At the end of this period, the filter bed was removed from the loop, but not exposed to air. The balance of the aqueous burley tobacco midrib extract was passed through the filter medium in a manner which precluded direct contact of the medium with air. The flow rate was adjusted so that the effluent had a concentration of 0.01 meq $NO_3^-$/ml (95% removal). Analysis of this extract showed that the organic acid content had decreased by a proportionate amount. An equivalent quantity of carbohydrate in the form of malic acid was added to the extract to replenish the losses.

The denitrified extract was concentrated and applied to the sheet by means of a sizepress. As a control, reconstituted tobacco was made exactly as described above, except the extract was not passed through the denitrifying medium.

Both sheets were then shredded and made into cigarettes. The cigarettes were allowed to burn freely and the time it took for a 40 mm length of each cigarette to burn was noted. In addition, the smoke produced by the cigarettes was analyzed by gas chromatography techniques to determine the amount of nitrogen oxides in the smoke of each cigarette. The results of this testing are as follows:

| Sample | Free Burn (min/40 mm) | Nitrogen Oxides ($\mu g$ $NO_x$) |
|---|---|---|
| Control | 3.2 | 880 |

-continued

| Sample | Free Burn (min/40 mm) | Nitrogen Oxides ($\mu g$ $NO_x$) |
|---|---|---|
| Denitrified | 9.2 | 90 |

EXAMPLE II

The bacterial culture was prepared in the same way that the filter bed described in Example 1 was prepared. The culture was then placed in a tank together with a volume of tobacco extract to be denitrified. The contents were stirred to provide intimate contact of the extract and the bacterial culture. The stirring was continued for six hours, whereupon the initial concentration of nitrate (0.20 meq $[NO_3^-]$/ml) had decreased to 0.02 meq $[NO_3^-]$/ml. The denitrified extract was then separated from the culture. Malic acid was then added as in Example 1, and the extract concentrated and applied to the sheet by means of a size press. Cigarettes were made and smoked as in Example 1. The results of the testing were as follows:

| Sample | Free Burn (min/40 mm) | Nitrogen Oxides ($\mu g$ $NO_x$) |
|---|---|---|
| Control | 3.4 | 900 |
| Denitrified | 8.8 | 100 |

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A method of making reconstituted tobacco, comprising the steps of:

(a) extracting natural tobacco with water to produce a tobacco extract and a fibrous residue, (b) forming the fibrous residue into a paper-like web, (c) preparing a microorganism bed by repeatedly cycling a particular quantity of tobacco extract through a filtering medium to cause microorganisms occurring naturally in the tobacco extract to multiply on the filtering medium, the cycling taking place in a substantially anaerobic environment and the microoganisms deposited on the filtering medium being capable of reducing nitrate in the tobacco extract to nitrogen, (d) thereafter passing another quantity of tobacco extract through the microorganism bed, in a substantially anaerobic environment, so that the extract comes into intimate contact with the microorganisms and nitrate is thereby removed from the extract by reduction of the nitrate to nitrogen, and (e) recombining the denitrated extract of step (d) with the fibrous tobacco web.

2. A method as defined in claim 1 wherein the cycling is continued until substantially all the nitrate in the particular quantity of tobacco extract has been removed.

3. A method as defined in claim 1 including the step of adding carbohydrate to the denitrated tobacco extract.

4. A method as defined in claim 1 including the step of adding protein to the denitrated tobacco extract.

* * * * *